US009666045B2

(12) United States Patent
Trundle

(10) Patent No.: US 9,666,045 B2
(45) Date of Patent: May 30, 2017

(54) SAFETY CONTROL FOR PRODUCT DISPENSERS

(71) Applicant: Alarm.com Incorporated, Tysons, VA (US)

(72) Inventor: Stephen Scott Trundle, Falls Church, VA (US)

(73) Assignee: Alarm.com Incorporated, Tysons, VA (US)

( * ) Notice: Subject to any disclaimer, the term of this patent is extended or adjusted under 35 U.S.C. 154(b) by 0 days.

(21) Appl. No.: 15/146,655

(22) Filed: May 4, 2016

(65) Prior Publication Data

US 2016/0325867 A1 Nov. 10, 2016

Related U.S. Application Data

(60) Provisional application No. 62/156,673, filed on May 4, 2015.

(51) Int. Cl.

| | |
|---|---|
| ***G08B 13/00*** | (2006.01) |
| ***G08B 13/08*** | (2006.01) |
| ***B67D 1/08*** | (2006.01) |
| ***B67D 1/00*** | (2006.01) |
| *G08B 13/196* | (2006.01) |
| *G08B 21/02* | (2006.01) |

(52) U.S. Cl.

CPC ..... *G08B 13/08* (2013.01); *B67D 1/0011* (2013.01); *B67D 1/0878* (2013.01); *B67D 1/0882* (2013.01); *G08B 21/0255* (2013.01); *G08B 21/0275* (2013.01); *G08B 13/19697* (2013.01); *G08B 21/0227* (2013.01)

(58) Field of Classification Search

CPC ..... B67D 1/00; B67D 1/009; B67D 1/0011; B67D 1/0878; B67D 1/0882; B67D 1/0884; G08B 13/00; G08B 13/08; G08B 21/0261; G08B 21/12

See application file for complete search history.

(56) References Cited

U.S. PATENT DOCUMENTS

| | | | | |
|---|---|---|---|---|
| 6,443,335 | B1 * | 9/2002 | Pinedjian | B67D 1/0006 141/104 |
| 6,695,168 | B2 * | 2/2004 | Pinedjian | B67D 1/0006 222/54 |
| 7,815,079 | B2 * | 10/2010 | Saveliev | B67D 1/0006 141/392 |
| 8,311,765 | B2 * | 11/2012 | Nielsen | B65D 83/203 702/130 |
| 8,938,366 | B2 * | 1/2015 | Nielsen | B65D 83/203 702/130 |

* cited by examiner

*Primary Examiner* — Van Trieu
(74) *Attorney, Agent, or Firm* — Fish & Richardson P.C.

(57) ABSTRACT

Techniques are described for processing sensor data associated with product dispensers at an establishment. The system is configured to monitor the location of product dispensers at an establishment and the system detects an alarm event related to the monitoring system based on the monitoring.

20 Claims, 8 Drawing Sheets

SAFETY CONTROL FOR PRODUCT DISPENSERS

CROSS-REFERENCE TO RELATED APPLICATION

This application claims the benefit of U.S. Provisional Application No. 62/156,673, filed May 4, 2015, and titled "Safety Control for a Product Dispenser," which is incorporated by reference.

TECHNICAL FIELD

This disclosure relates to monitoring technology.

BACKGROUND

Some restaurants may be equipped with one or more self-serving dispensers, for example, ketchup and mustard dispensaries at fast food restaurants, and creamer and sugar dispensaries at coffee shops. Commonly, these dispensers are not closely monitored by the staff at the restaurant, and it may be easy for someone with ill intent to intentionally poison the contents of the dispensers. For example, someone may poison the contents of the creamer dispensers at a coffee shop. These restaurants have the added responsibility of ensuring the safety of the contents of the dispensers used by its patrons.

SUMMARY

According to one aspect, a system for processing sensor data associated with product dispensers at an establishment may include proximity sensors that are configured to enable sensing of location of the product dispensers at the establishment, at least one proximity sensor being mounted to each product dispenser, condition sensors that are configured to sense physical conditions associated with the product dispensers, at least one condition sensor being mounted to each product dispenser, a transmitter that is configured to communicate with the proximity sensors, and a control unit that includes at least one processor, the control unit being configured to perform operations that include receiving, from at least one of the condition sensors, at least one sensed physical condition associated with a particular product dispenser among the product dispensers, determining that the particular product dispenser has been opened based on the at least one sensed physical condition associated with the particular product dispenser, based on communication between the transmitter and at least one proximity sensor mounted to the particular product dispenser, detecting a location of the particular product dispenser at a time that the particular product dispenser has been opened, based on the detected location of the particular product dispenser at a time that the particular product dispenser has been opened, determining whether the particular product dispenser is within a threshold distance from the transmitter at the time that the particular product dispenser has been opened, and based on a determination that the particular product dispenser is located outside the threshold distance from the transmitter at the time that the particular product dispenser has been opened, trigging an alarm event.

Implementations according to this aspect may include one or more of the following features. For example, the control unit may detect a refill event based on a determination that the particular product dispenser is located within the threshold distance from the transmitter at the time that the particular product dispenser has been opened. The control unit may detect a refill event based on detecting a change in the physical condition associated with the particular product dispenser associated with the at least one condition sensor. The control unit may trigger an alarm event based on the transmitter failing to establish communication with the at least one proximity sensor mounted to the particular product dispenser. The condition sensors may include a pressure differential sensor, a temperature differential sensor, and a light sensor. Trigging the alarm event may include generating an alarm notification and communicating the generated alarm notification to a device of a user associated with the establishment. Trigging the alarm event may include controlling the particular product dispenser to provide a visible alert. Trigging the alarm event comprises controlling the particular product dispenser to provide an audible alert. The system may include a monitoring application server that is configured to electronically receive, either directly or via a network communications module, data communications from the condition sensors and from at least one of the transmitter or the proximity sensors. The system may include one or more cameras that are configured to monitor the location of the product dispensers, where the one or more cameras are configured to capture one or more images of the product dispensers at a predetermined time, determine a count of the number of the product dispensers at the predetermined time based on the captured one or more images, and based on a determination that the count of the number of product dispensers is below an acceptable count for a threshold period of time, triggering an alarm event.

According to another aspect, a system for monitoring product dispensers at an establishment may include an electronic holster that is configured to physically retain the product dispensers at the establishment, that is configured to detect physical presence of the product dispensers at the electronic holster, and that is configured to receive electronic information from the product dispensers based on the product dispensers being retained by the electronic holster, communication devices that are associated with the product dispensers and that are configured to electronically communicate information from the product dispensers to the electronic holster, at least one communication device being mounted to each of the product dispensers, and a control unit that includes at least one processor, the control unit being configured to perform operations including maintaining, in electronic storage, communication codes associated with the product dispensers, each product dispenser being associated with at least one communication code, detecting presence, at the electronic holster, of a particular product dispenser, based on detecting presence of the particular product dispenser at the electronic holster, determining whether the particular product dispenser has communicated to the electronic holster a communication code maintained in electronic storage, and based on a determination that the particular product dispenser has failed to communicate to the electronic holster a communication code maintained in electronic storage, triggering an alarm event.

Implementations according to this aspect may include one or more of the following features. Trigging the alarm event may include generating an alarm notification and communicating the generated alarm notification to a device of a user associated with the establishment. Trigging the alarm event may include controlling the particular product dispenser to provide a visible alert. Trigging the alarm event may include controlling the particular product dispenser to provide an audible alert. The system may include proximity sensors that are configured to enable sensing of location of the product dispensers at the establishment, at least one proximity sensor being mounted to each product dispenser, condition sensors that are configured to sense physical conditions associated with the product dispensers, at least one condition sensor being mounted to each product dispenser, and a transmitter that is configured to communicate with the proximity sensors. The system may detect a refill event based on a determination that the particular product dispenser is located within a threshold distance from the transmitter at the time that the particular product dispenser has been determined to be opened based on at least one sensed physical condition associated with the particular product dispenser. Detecting a refill event may include detecting a change in the physical condition associated with the particular product dispenser associated with the at least one condition sensor. Trigging the alarm event may include triggering an alarm event based on the transmitter failing to establish communication with the at least one proximity sensor mounted to the particular product dispenser. The system may include one or more cameras that are configured to monitor the location of the product dispensers, wherein the one or more cameras are configured to capture one or more images of the product dispensers at a predetermined time, determine a count of the number of the product dispensers at the predetermined time based on the captured one or more images, and based on a determination that the count of the number of product dispensers is below an acceptable count for a threshold period of time, triggering an alarm event. The system may include a monitoring application server that is configured to electronically receive, either directly or via a network communications module, data communications from the condition sensors and from at least one of the transmitter or the proximity sensors.

The details of one or more implementations are set forth in the accompanying drawings and the description below. Other features will be apparent from the description and drawings.

DETAILED DESCRIPTION

Techniques are described for providing a monitoring system that monitors one or more product dispensers at an establishment. The monitoring system may monitor the one or more product dispensers to detect any unauthorized refilling or openings, removal from a specified location, or any other such unauthorized event. The monitoring system may detect an unauthorized event based on sensors associated with one of the one or more dispensers, and may generate an alert based on the detected event. For example, the monitoring system may detect an unauthorized opening of a dispenser, and may send an alert to the manager of the store. The monitoring system may detect that a sensor associated with a dispenser is outside of a predetermined distance from a transmitter associated with the system. For example, the monitoring system may detect when a customer moved the dispenser away from the designated dispensing area.

In some implementations, the monitoring system may include a holster that synchronizes with the one or more product dispensers. The monitoring system may detect when a dispenser that does not communicate valid credentials is placed in the holster, and may generate an alert to the manager of the establishment. For example, a customer may poison the contents of a dispenser that looks similar to the dispensers used in an establishment, and may replace one of the registered dispensers with the imposter dispenser in the holster. The monitoring system may detect the failed synchronization between the imposter dispenser and the holster, and may generate an alert to the manager of the establishment.

In some examples, the monitoring system may monitor the location of the one or more product dispensers at an establishment using video analytics. In these examples, the establishment may be equipped with one or more cameras that monitor the location and/or the number of the dispensers. In some implementations, the one or more dispensers may be equipped with an electromechanical valve that may shut off the flow from the dispenser. The flow from a dispenser may be shut off when the dispenser is detected to be outside the threshold distance from a transmitter. In some examples, the valves may shut off flow from the dispenser when the dispenser fails to synchronize with the holster after a predetermined time period.

Figure 1:
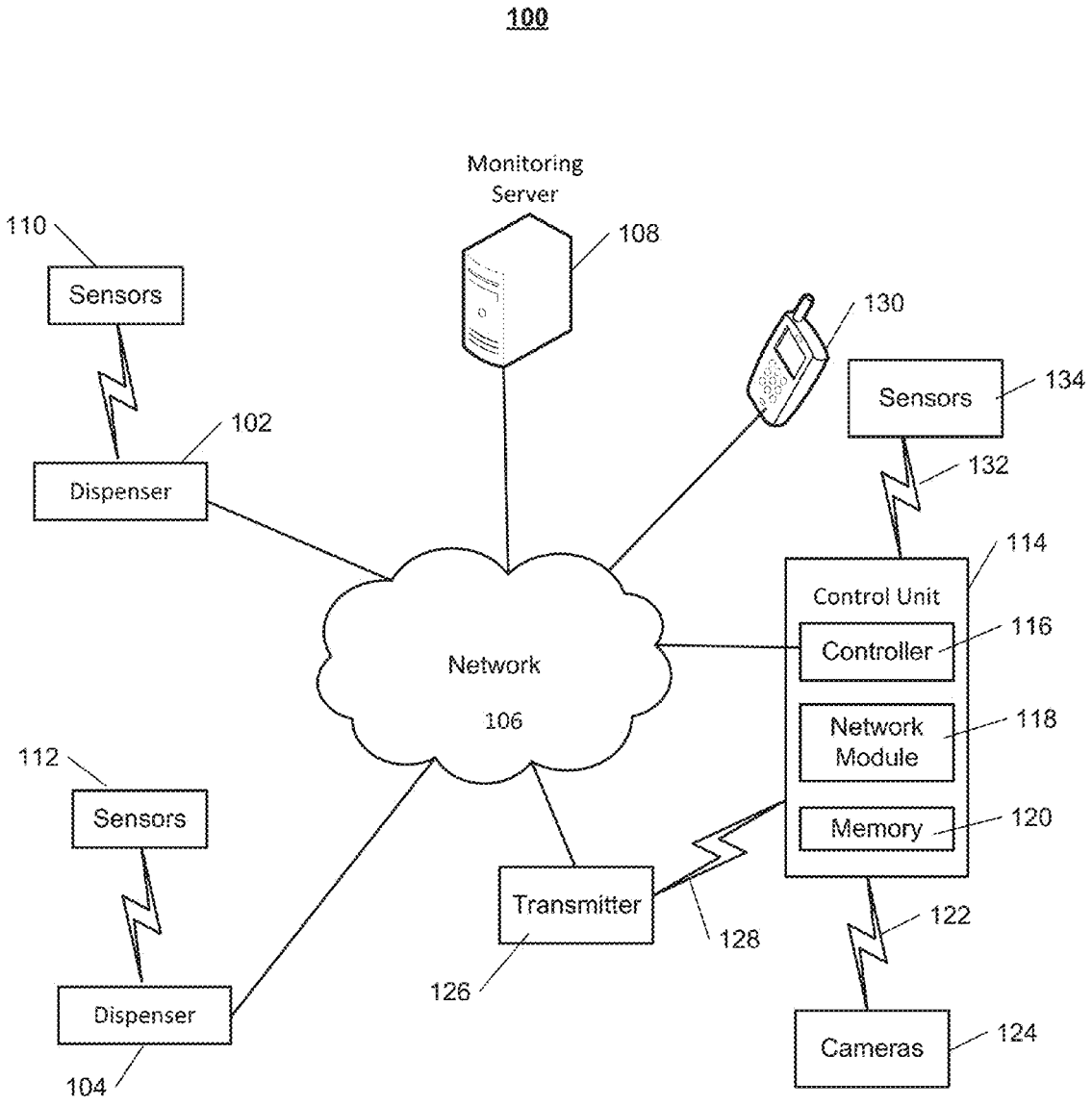
FIG. 1 illustrates a diagram of an example of a system.

FIG. 1 illustrates an example of a system 100 configured for monitoring one or more product dispensers at an establishment. The system 100 includes a network 106, a central control unit 114, one or more dispensers 102, 104, a transmitter 126, and a monitoring server 108. In some examples, the network 106 facilitates communications between the central control unit 114, the one or more dispensers 102, 104, and the monitoring server 108. The network 106 may include, for example, one or more of the Internet, Wide Area Networks (WANs), Local Area Networks (LANs), analog or digital wired and wireless telephone networks (e.g., a public switched telephone network (PSTN), Integrated Services Digital Network (ISDN), a cellular network, and Digital Subscriber Line (DSL)), radio, television, cable, satellite, or any other delivery or tunneling mechanism for carrying data.

Network 106 may include multiple networks or subnetworks, each of which may include, for example, a wired or wireless data pathway. The network 106 may include a circuit-switched network, a packet-switched data network, or any other network able to carry electronic communications (e.g., data or voice communications). For example, the network 106 may include networks based on the Internet protocol (IP), asynchronous transfer mode (ATM), the PSTN, packet-switched networks based on IP, X.25, or Frame Relay, or other comparable technologies and may support voice using, for example, VoIP, or other comparable protocols used for voice communications. The network 106 may include one or more networks that include wireless data channels and wireless voice channels. The network 106 may be a wireless network, a broadband network, or a combination of networks including a wireless network and a broadband network.

The central control unit 114 includes a controller 116, a network module 118, and memory 120. The controller 116 is configured to control a product dispenser monitoring system that includes the central control unit 114. In some examples, the controller 116 may include a processor or other control circuitry configured to execute instructions of a program that controls operation of a monitoring system. In these examples, the controller 116 may be configured to receive input from sensors, detectors, or other devices included in the monitoring system. For example, the controller 116 may be configured to communicate with the transmitter 126.

The central control unit 114 may be configured to receive input from one or more sensors 134. The sensors 134 may include multiple sensors configured to act as an alarm system for the monitored establishment. The multiple sensors 134 may include a contact sensor, a motion sensor, a glass break sensor, or any other type of sensor included in an alarm system or security system. The sensors 134 also may include an environmental sensor, such as a temperature sensor, a water sensor, a rain sensor, a wind sensor, a light sensor, a smoke detector, a carbon monoxide detector, an air quality sensor, etc. In some examples, the sensors 134 may include a radio-frequency identification (RFID) sensor that identifies a particular article that includes a pre-assigned RFID tag. In addition, the sensors 134 may include a video/photographic camera or other type of optical sensing device configured to capture images and may include an energy consumption sensor for appliances and devices in a property monitored by the monitoring system. The sensors 134 may be used to assist in performing safety control for product dispensers by supplementing and/or verifying other sensed data from the product dispensers.

The sensors 134 communicate with the central control unit 114 over communication link 132. The communication link 132 may be a wired or wireless data pathway configured to transmit signals from the sensors 134 to the central control unit 114. The sensors 134 may continuously transmit sensed values to the central control unit 114, periodically transmit sensed values to the central control unit 114, or transmit sensed values to the controller 112 in response to a change in a sensed value. The central control unit 114 may receive signals from the sensors 134 and detect an alarm event based on the sensed values. For example, at least one of sensors 134 may be a contact sensor provided on a door to the establishment and the communication link 132 may be a wireless connection between the sensor 120 and the controller 112. In this example, the sensor may sense that the door has been opened (e.g., absence of a connection between contacts included as part of the sensor) and wirelessly transmit data over communication link 132 to the central control unit 114 indicating that the door has been opened. The central control unit 114 receives the data from the sensor over the communication link 132 and determines that an alarm event (e.g., the door opened) has occurred based on the signal from the sensor. The central control unit 114 controls operation of the alarm system based on the determination that the alarm event has occurred.

The product dispensers monitoring system that includes the central control unit 114 includes one or more sensors 110 and 112 associated with one or more product dispensers 102 and 104. The one or more sensors 110 and 112 may be condition sensors that may have the ability to monitor the physical conditions associated with each of the product dispensers to which the sensor is associated with. For example, the one or more sensors 110 and 112 may monitor light intensity, pressure differentials, and temperature differentials of the product dispensers. The one or more sensors 110 and 112 may also include proximity sensors that are configured to sense the location of the product dispenser to which it is mounted. The one or more sensors 110 and 112 may be battery powered. In some examples, the one or more sensors 110 and 112 may be powered by solar energy, electrochemical motion energy, RF harvesting, or any other suitable type of energy. In some implementations, the one or more sensors 110 and 112 may be integrated into the structure of the dispenser. For example, the dispenser may be manufactured with the sensing abilities. In some implementations, the one or more sensors 110 and 112 may be mounted to the inner walls of the one or more product dispensers. The one or more sensors 110 and 112 associated with the one or more dispensers 102 and 104 may communicate through network 106 with the transmitter 126. In some implementations, the one or more sensors 110 and 112 may communicate directly with the transmitter 126 through a communication link. The communication link may be a wired or wireless data pathway configured to transmit signals from the one or more sensors. In some implementations, the one or more sensors 110, 112 associated with the one or more dispensers 102 and 104 may communicate directly with a security control panel. The one or more sensors 110 and 112 may communicate location information, alert information, or any other appropriate information to the security control panel. In some implementations, the one or more sensors 110 and 112 associated with the one or more dispensers 102 and 104 may communicate with a gateway or a router with different application capabilities. For example, the one or more sensors may communicate sensor information to the security control panel via a Wi-Fi gateway.

The network module 118 is a communication device configured to exchange communications over the network 106. The network module 118 may be a wireless communication module configured to exchange wireless communications over the network 106. For example, the network module 118 may be a wireless communication device configured to exchange communications over a wireless data channel and a wireless voice channel. In this example, the network module 118 may transmit data over a wireless data channel and establish a two-way voice communication session over a wireless voice channel. The wireless communication device may include one or more of a GSM module, a radio modem, cellular transmission module, or any type of module configured to exchange communications in one of the following formats: GSM or GPRS, CDMA, EDGE or EGPRS, EV-DO or EVDO, UMTS, or IP. The network module 118 also may be a wired communication module configured to exchange communications over the network 106 using a wired connection. For instance, the network module 118 may be a modem, a network interface card, or another type of network interface device. The network module 118 may be an Ethernet network card configured to enable the central control unit 110 to communicate over a local area network and/or the Internet. The network module 118 also may be a voiceband modem configured to enable the alarm panel to communicate over the telephone lines of Plain Old Telephone Systems (POTS).

In some implementations, the monitoring system may include an electronic holster for the one or more product dispensers 102, 104. In these implementations, the electronic holster may synchronize with the one or more product dispensers when the dispensers are placed in the holster. For example, the dispenser may communicate an encrypted code to the holster to facilitate the synchronization with the holster. In these examples, the encrypted code may be communicated through the communication link between the dispenser and the holster. In some examples, the holster may synchronize with the dispenser based on radio frequency identification (RFID). For example, the holster may be equipped with an RFID reader that syncs with an RFID tag on the one or more food dispensers. The electronic holster may be a cradle that is configured to hold the one or more product dispensers. In some examples, the electronic holster may be a table top or a counter top, or any other suitable surface in an establishment.

The product dispenser monitoring system may include one or more cameras 124 that monitor the one or more product dispensers 110 and 112 at an establishment. The one or more dispensers 110 and 112 may be monitored using video analytics. The one or more cameras 124 may be video/photographic cameras or other types of optical sensing devices configured to capture images. The one or more cameras 124 may communicate to the control unit 114 through a communication link 122. The controller 116 of the control unit 114 may execute video analytics software. The commands of the video analytics software may be communicated to the one or more cameras 124 via the communication link 122. In some implementations, the controller 116 may identify all product dispensers in the designated area and count the number of product dispensers in the designated area. In these implementations, the product dispensers may have a unique color and/or marking pattern that enables the dispensers to be automatically identified through video analytics, such as by using pattern matching. The control unit 114 may generate an alert when the count drops below an acceptable count for a threshold period of time. In some implementations, the one or more cameras 124 may be configured to capture static images of the one or more dispensers 102, 104, and also configured to capture video images of the one or more dispensers 102, 104.

The monitoring server 108 is an electronic device configured to provide monitoring services by exchanging electronic communications with the control unit 114 and one or more user devices 130 over the network 106. The monitoring server 108 may exchange electronic communications with the network module 118 included in the central control unit 114 to receive information regarding alarm events. The monitoring server 108 may communicate detected alarm events to the one or more user devices 130. The one or more user devices 130 may be user devices associated with a store manager, a worker, or any suitable user associated with an establishment monitored by the monitoring system. The detected alarm events may be communicated to the one or more user devices 130 over the network 106. For example, the detected alarm event may be communicated as a text message, phone call, email, SMS message, or any other suitable mode of communication. The user device 130 may include a cell phone, a smart phone, a tablet PC, a personal digital assistant ("PDA"), or any other portable device configured to communicate over a network and display information. For example, implementations may also include Blackberry-type devices, electronic organizers, iPhone-type devices, iPod devices or other portable music players, other communication devices, and handheld or portable electronic devices for gaming, communications, and/or data organization. The user device 130 may perform functions unrelated to the monitoring system, such as placing personal telephone calls, playing music, playing video, displaying pictures, browsing the Internet, maintaining an electronic calendar, etc.

In some implementations, the product dispenser monitoring system includes a transmitter 126 that may be located in an area designated for one or more product dispensers 102, 104. In some examples, a store may be equipped with multiple transmitters. The transmitter 126 may be configured to communicate with the one or more sensors 110, 112 associated with the one or more product dispensers 102,104. The transmitter 126 may communicate with the one or more sensors 110, 112 via the network 106. In some examples, the transmitter 126 may communicate with the one or more sensors 110, 112 via a communication link.

The transmitter 126 may be configured to communicate with the central control unit 114. The transmitter 126 may communicate with the central control unit 114 via the network 106. In some implementations, the transmitter 126 may communicate with the control unit via a communication link. In some implementations, the transmitter 126 may communicate to a security control panel. In some implementations, the transmitter 126 may communicate with a gateway device.

The product dispenser monitoring system may monitor refill events associated with the one or more food dispensers 102, 104. The one or more sensors 110, 112 associated with the one or more dispensers 102, 104, the transmitter 126, and the control unit 114 communicate with each other to monitor and log the refill events. The control unit 114 may be configured to generate an alert when an unscheduled or otherwise irregular refill event is detected. A refill event may be registered when one or more sensors associated with a dispenser senses light. In some implementations, a refill event may be registered when one or more sensors associated with a dispenser senses a change in light intensity. In some implementations, a refill event may be registered when one or more sensors associated with a dispenser senses a pressure differential, or senses a temperature differential. The transmitter 126 may be configured to register a regular refill event as a refill event that occurs when the one or more sensors associated with the dispenser is within a threshold distance from the transmitter 126. For example, the control unit logs a refill event when a sensor associated with a ketchup dispenser detects light, and the sensor is within the threshold distance from the transmitter 126. In some implementations, the one or more sensors associated with the dispenser initializes communication with the transmitter to establish the sensor's distance from the transmitter, only when the one or more sensors detect a change in light intensity. In other implementations, the transmitter may periodically communicate with the one or more sensors associated with the one or more dispensers. In these implementations, the transmitter may generate an alert when communication to the one or more sensors is compromised. For example, the transmitter 126 may generate an alert when communication to one or more sensor is blocked by a radio frequency (RF) jammer.

The control unit 114 may register a refill event as a regular refill event when the sensor associated with the dispenser is within the predetermined threshold distance from the transmitter 126. The logged refill event may include the open time, the close time, and the total time for the refill. In some implementations, the logged refill event is stored in memory locally at the transmitter 126. The logged refill event also may be communicated to a cloud application and stored in a secured repository. In some implementations, the one or more sensors 110, 112 associated with the one or more dispensers 102, 104, may be configured to monitor the usage of the food products in the dispensers. The one or more sensors may monitor the amount of product used from the dispenser, the number of refills that occur, and the usual refill times for each of the different dispensers. For example, the transmitter 120 may store the refill information for each of the dispensers, and may generate a summarized report itself or with one or more of the control unit 114 and the monitoring server 108. The report may indicate patterns of refill history for the dispensers that reflect the timing of refills (e.g., time of day, day of week, duration of refill event, etc.), measurements of the dispenser (e.g., volume held by dispenser at time of refill event, temperature, pressure, etc.), and users that performed the refills (e.g., known employees, temporary employees, other users, etc.). The patterns of refill history may be compared to newly-detected refill events to identify anomalistic refill events that warrant investigation to ensure the newly-detected refill events were proper.

The transmitter 126 may generate an alert event when a sensor detects a refill event, but the sensor is not within the threshold distance from the transmitter. For example, the transmitter 126 may generate an alert when a dispenser is opened by a customer at a table. In some implementations, the transmitter 126 may generate an audible alert to notify a staff member of the event. For example, the transmitter 126 may beep continuously when a refill event occurs outside the threshold distance from the transmitter 126.

In some examples, the transmitter may communicate the detected event to the control unit 114. The control unit 114 may generate an alert message that is communicated to the user device 130 of a manager or other worker at the establishment monitored by the monitoring system. For example, the control unit 114 may generate a text message to the shift manager, when an alert is detected. The text message may include details about the detected event, such as, a description of the event and may identify the sensor that triggered the event.

In some implementations, the transmitter 126 may generate an alert event based on refill schedules stored in memory. For instance, the transmitter 126 may generate an alert if a refill event is detected that does not correspond to a predetermined refill schedule. For example, the transmitter 126 may generate an alert when the sensor associated with a creamer dispenser that is usually refilled twice an hour indicates that the creamer dispenser has not been refilled in the past hour. In another example, the transmitter 126 may generate an alert when the sensor associated with a creamer dispenser that is usually refilled twice an hour is refilled a third time in an hour period and the third refill event lasts a relatively short period of time and occurs when the creamer dispenser more than half full.

In some implementations, the one or more dispensers may be stored in a designated holster that is configured to electronically synchronize with the one or more dispensers. The holster may be designed to synchronize simultaneously with the one or more dispensers. For example, the holster may be a rack that holds the sugar, creamer, and milk dispensers at a coffee shop. The holster may be in electronic communication with the control unit 114 through a communication link. The one or more dispensers may be configured to generate an alert when synchronization with the holster has not occurred within a threshold period of time. For example, the sugar dispenser may generate an alert when it has not synchronized with the holster for 60 seconds.

In some examples, the alert generated by the dispenser may be an audible alert, for example, a beep or a chime. The alert generated by the dispenser also may be a visible alert, for example, the dispenser may light a red light emitting diode (LED.) In these examples, the dispenser may be equipped with an LED light mounted to the outer surface of the dispenser.

In some implementations, the LED mounted to the outer surface of the dispenser may light green when the dispenser has successfully synchronized with the holster, and may light red when the dispenser has not synchronized with the holster within a threshold period of time. The dispenser may generate a message to the control unit 114 when it has not been synchronized with the holster within a threshold period. The control unit 114 may communicate the message received by the dispenser to the user device 130 of an employee of the establishment and/or the monitoring server 108. For example, the transmitter 126 may generate an alert message to a smart phone of the store manager that runs a mobile application associated with the food safety monitoring system.

In some implementations, the synchronization between the one or more dispensers and the holster employs RFID technology. In these implementations, the holster may be equipped with an RFID reader, and the one or more dispensers may each be equipped with an RFID tag. The RFID tag on a dispenser may be read by the RFID reader when the dispenser is cradled on the holster. When a dispenser that is not equipped with an RFID tag, or a dispenser that is equipped with an RFID tag does not store corresponding electronic information to facilitate communication with the RFID reader, the synchronization between the holster and the dispenser fails. The holster may generate an alert when the synchronization between the holster and the dispenser fails. The holster may generate an audible alert when a dispenser that does not have an RFID tag is cradled in the holster. For example, the holster may generate a beeping alert if a customer tried to place an imposter dispenser on the holster. The holster may communicate the failed synchronization attempt to the transmitter. The transmitter may generate an alert message to the user device of the shift manager.

In some implementations, the synchronization between the one or more dispensers and the holster involves the exchange of an encrypted electronic code. In these implementations, the holster may be in electronic communication with the control unit 114. The control unit may communicate an encrypted synchronization code to the holster. The synchronization code may be valid for a predetermined period of time. The control unit may communicate the encrypted synchronization code to the transmitter which in turn may then communicate the code to the one or more dispensers. When a worker initially places a dispenser in the holster, the dispenser and the holster exchange synchronization codes. The holster confirms the synchronization with the holster by confirming the match between the two synchronization codes. The holster may generate an alert when the synchronization code provided by the dispenser does not match the synchronization code of the holster. For example, a customer may replace a dispenser with an imposter that does not communicate the correct code to the holster. In some examples, the alert may be an audible alert generated by the holster.

In some implementations, the holster may be a rack that includes one or more openings for the one or more dispensers. The holster may be placed on a counter or a table designated for the one or more dispensers. Each opening of the holster may be equipped with one or more LED lights that may be used to indicate whether the dispenser placed in the opening has been synchronized or not. For example, the holster opening may illuminate a red LED when the dispenser placed in the opening failed to communicate the correct synchronization code. In addition, the holster opening may illuminate a green LED when the dispenser placed in the opening communicates the correct synchronization code.

In some implementations, the holster may be equipped with an LED that is capable of emitting several different colors. In these implementations, the synchronization code may be updated on a period basis. The color displayed by the LED may be based on the synchronization code and/or the length of time since the synchronization code has changed. The control unit may generate a synchronization code and an associated LED color, and communicate the code and color to the holster. When a dispenser is placed into an opening of the holster, and synchronization is successful, the LED on the dispenser may light the LED the color as instructed by the control unit. In examples where an imposter dispenser is placed in the holster, the dispenser LED fails to light as the color on the holster and may be easily identified as counterfeit.

In some implementations, the holster may be an entire table or a countertop. In these implementations, the one or more dispensers may be synchronized when placed at any location on the table or countertop. In some examples, the transmitter may be integrated with the holster. For example, the transmitter may be configured to act as the holster.

In some implementations, the one or more dispensers at an establishment may be monitored using video analytics. The food safety monitoring system may include one or more cameras 124 that are in electronic communication with the control unit 114. The control unit 114 may communicate commands of the video analytics software to monitor the one or more dispensers. The one or more cameras may recognize the one or more dispensers, and may count the number of dispensers in the designated dispenser area. The one or more cameras may communicate the count information to the controller 116 of the control unit 114. The control unit 114 may generate an alert when the count information received from the one or more cameras does not match the acceptable count numbers. For example, an alert would be generated when the count varies from the acceptable count for more than five minutes. In these examples, the network module 118 of the control unit 114 may generate a text message alert to the user device of the shift manager at the establishment.

In some implementations, the one or more dispensers may transmit their location to the one or more cameras. The one or more dispensers may communicate with the one or more cameras via a gateway. In some implementations, the one or more dispensers may communicate with the one or more cameras via Wi-Fi, RF, or any other suitable means of electronic communication. The one or more dispensers may communicate location using triangulation of coordinates based on the one or more other sensors and the transmitter in the establishment.

The control unit 114 may command the one or more cameras to track the position of the one or more dispensers. The one or more cameras may be motorized, and have the ability to adjust its position to alter its field of view. In some implementations, the one or more cameras may be adjusted to include one or more dispensers in their field of view.

In some implementations, each camera monitors the position of one dispenser. The control unit may generate an alert when a dispenser is outside the field of view of the one or more cameras for a threshold period of time. For example, the control until may generate an alert text message to a store manager when a dispenser is out of the field of view of the one or more cameras for more than 30 seconds.

Figure 2:
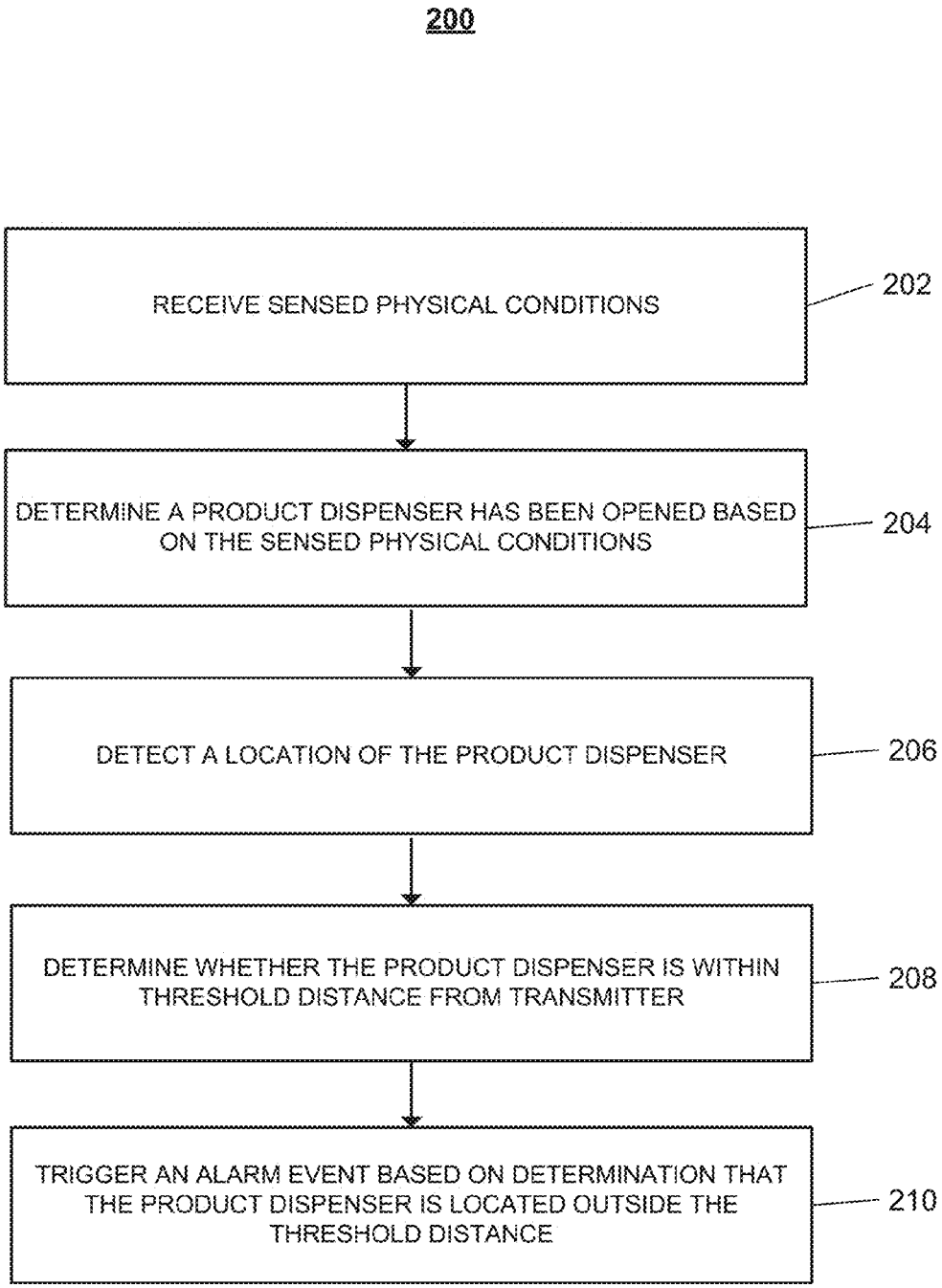
FIG. 2 illustrates an example process for triggering an alarm event.

FIG. 2 illustrates an example process 200 for triggering an alarm event. The process may include receiving sensed physical conditions from at least one of the condition sensors (202). The control unit 114 may receive sensor data from a condition sensor that senses the physical conditions associated with a particular dispenser. For example, the control unit 114 may receive sensor data from a pressure differential sensor associated with a particular product dispenser. In some examples, the control unit 114 may receive sensor data from a temperature differential sensor or a light sensor. In some implementations, the control unit 114 may receive sensor data from each of the one or more condition sensors that are associated with the particular product dispenser. The control unit 114 may be configured to periodically receive sensor data from each of the one or more condition sensors associated with the product dispensers. For example, the control unit may be configured to receive sensor data from each of the one or more condition sensors every thirty seconds. In some implementations, the control unit 114 may be configured to receive sensor data from any of the one or more condition sensors when one of the sensors has detected a change in sensed values.

The control unit 114 may determine the particular product dispenser has been opened based on the at least one sensed physical condition associated with the particular product dispenser (204). For example, the control unit 114 may receive sensor data from the light sensor associated with the particular product dispenser that indicates a change in light intensity. The change in the light intensity may indicate that the particular product dispenser has been opened, and the light sensor associated with the product dispenser has detected an increase in light intensity. In some implementations, the control unit 114 may detect a change in the sensor data received from the pressure differential condition sensor. A decrease in the sensed pressure differential data may indicate that the product dispenser has been opened.

The control unit 114 may detect a location of the particular product dispenser at a time that the particular product dispenser has been opened based on communication between the transmitter and at least one proximity sensor mounted to the particular product dispenser (206). Once the control unit 114 has determined that the particular product dispenser has been opened, the control unit 114 may prompt communication between the transmitter and the proximity sensor mounted to the particular product dispenser. The transmitter 126 and the proximity sensor mounted to the particular product dispenser may communicate through the network 106. The transmitter 126 may determine, based on the data received from the proximity sensor, the location of the particular product dispenser to which the sensor is mounted. The location information of the proximity sensor may be communicated to the control unit 114 by the transmitter 126.

The control unit 114 may determine whether the particular product dispenser is within a threshold distance from the transmitter at the time that the particular product dispenser is opened, based on the detected location of the particular product dispenser (208). The control unit 114 may use the location information of the proximity sensor received from the transmitter 126 to determine whether the product dispenser, to which the proximity sensor is mounted, is within a threshold distance from the transmitter 126. The transmitter 126 may be mounted to a refill counter at an establishment equipped with product dispenser monitoring. system.

The control unit 114 may trigger an alarm event, based on a determination that the particular product dispenser is located outside the threshold distance from the transmitter, at the time that the particular product dispenser has been opened (210). For example, the control unit 114 may trigger a visual alarm alert when the particular dispenser is located outside the threshold distance from the refill counter at an establishment. The control unit 114 may communicate commands to the transmitter to blink, or flash, or produce any other visible alters. In some examples, the control unit 114 may trigger an audible alarm alert. For example, the control unit 114 may communicate commands to the transmitter to produce audible alerts. In some implementations, the control unit 114 may communicate commands to the monitoring server 108 to communicate the detected alarm event to the user device 130 of a user associated with the monitored establishment. For example, the detected alarm event may be communicated as a SMS or MMS text to the manager of the establishment.

The control unit 114 may detect a refill event based on a determination that the particular product dispenser is located within the threshold distance from the transmitter at the time the particular product dispenser has been opened. A refill event may be detected when at least one of the condition sensors associated with a particular dispenser indicates that the particular dispenser is opened, and the detected location of the proximity sensor associated with the particular dispenser indicates the dispenser is within the threshold distance. For example, the product dispenser may be at the refill counter being refilled by an employee at the monitored establishment. The control unit 114 may log one or more detected refill events and store the logged events in memory 120. The logged refill events may include the time opened, the time closed, and the total refill time. In some implementations, the one or more sensors 110, 112 associated with the one or more dispensers 102, 104 may be configured to monitor the usage of the food products in the dispensers. The one or more sensors 110, 112 may monitor the amount of product used from the dispenser, the number of refills that occur, and the usual refill times for each of the different one or more dispensers. For example, the control unit 114 may store the refill information for each of the one or more dispensers, and may generate a summarized report. The report may indicate patterns of refill history for the dispensers that reflect the timing of refills (e.g., time of day, day of week, duration of refill event, etc.), measurements of the dispenser (e.g., volume held by dispenser at time of refill event, temperature, pressure, etc.), and users that performed the refills (e.g., known employees, temporary employees, other users, etc. detected, for example, using sensors 134 that monitor the establishment). The patterns of refill history may be compared to newly-detected refill events to identify anomalistic refill events that warrant investigation to ensure the newly-detected refill events were proper.

Figure 3A:
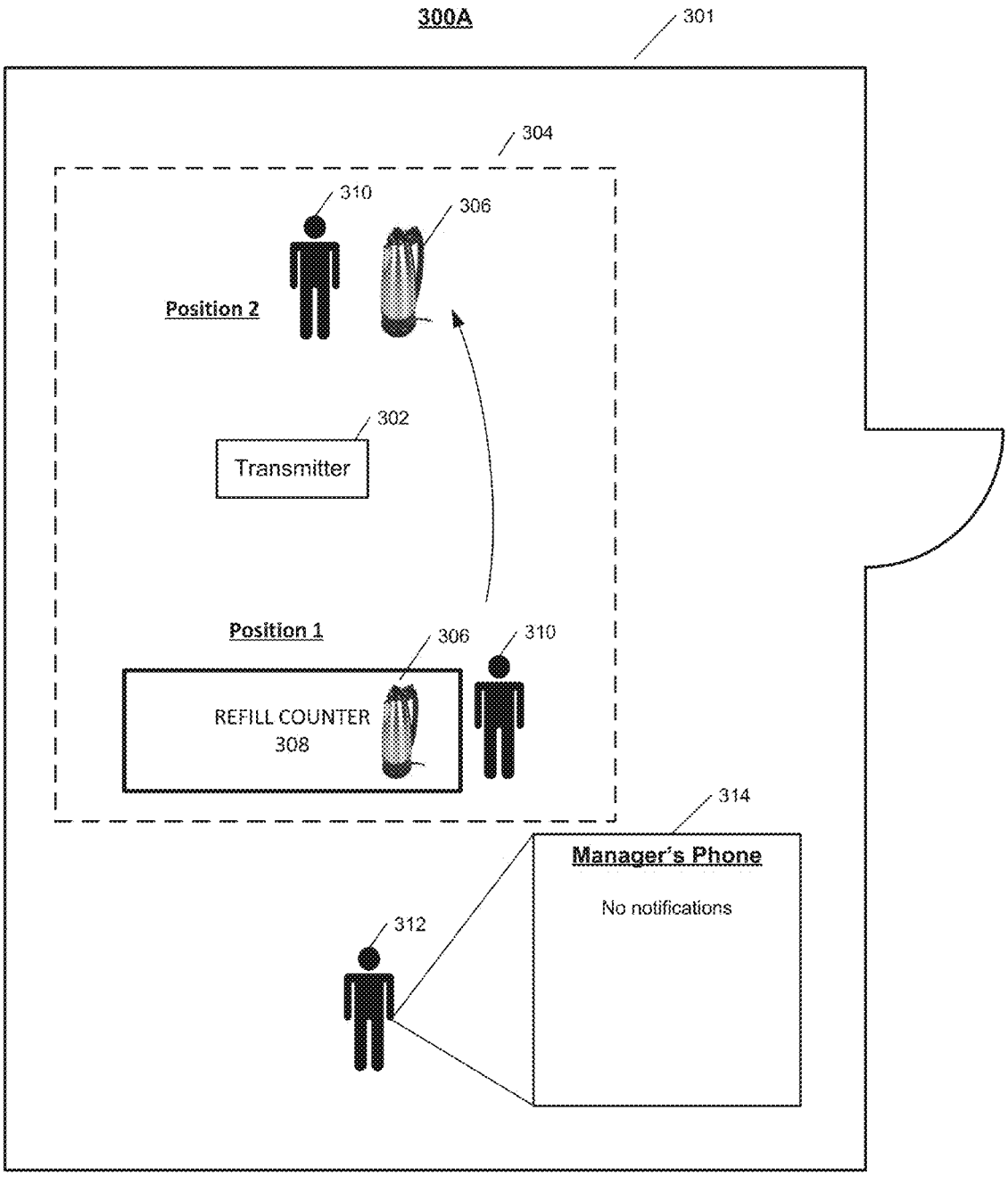
FIG. 3A illustrates an example of detecting a refill event.

FIG. 3A illustrates an example 300A of detecting a refill event. As illustrated, a monitored establishment 301, for example a coffee shop, may include a transmitter 302, a product dispenser 306, and a refill counter 308. In the example illustrated in FIG. 3A, a user 310 at the establishment 301 moves a product dispenser 306 from the designated refill counter 308. A product dispenser monitoring system monitors events at the establishment 301 based on data from one or more sensors associated with the one or more product dispensers at the establishment 301.

The user 310 may be a worker at the monitored establishment 301. The user 310 may move the dispenser 306 from position 1 to position 2 to refill the dispenser 306. When the user 310 opens the product dispenser 306 (position 2 of FIG. 3A), the monitoring system detects the opening of the dispenser. The control unit 114 of the monitoring system detects the product dispenser 306 has been opened based on receiving, from at least one of the condition sensors associated with the particular product dispenser, at least one sensed physical condition. For example, when opened, the pressure differential sensor associated with the particular product dispenser may sense a change in the pressure differential of the dispenser 306. The pressure differential sensor may communicate the sensed data to the control unit 114. The detected change in pressure of the dispenser 306 may indicate that the product dispenser 306 has been opened. In some examples, the temperature differential sensor associated with the product dispenser may detect a change and communicate the change to the control unit 114. Also, a light sensor may detect a change and communicate the change to the control unit 114. In some implementations, the control unit 114 may detect that the dispenser is opened based on each of the condition sensors associated with the dispenser sensing condition changes.

The control unit 114 of the monitoring system detects a location of the dispenser 306 at the time of the opening of the dispenser 306. The control unit 114 then commands the proximity sensor associated with the dispenser 306 to communicate with the transmitter 302 to detect whether the dispenser 306 is within a threshold distance 304 from the transmitter. In some implementations, the transmitter may be located at the refill counter. For the example illustrated in FIG. 3A, the transmitter is located in any suitable location within the monitored establishment 301. The control unit 114 determines the product dispenser 306 is within the threshold distance 304 from the transmitter 302 based on the sensor data from received from the proximity sensor associated with the product dispenser 306. The manager 312 of the monitored establishment 301 does not receive any alert notifications on his user device 314 based on the control unit 114 of the monitoring system determining that the product dispenser 306 in within the threshold distance 304 of the transmitter 302.

Figure 3B:
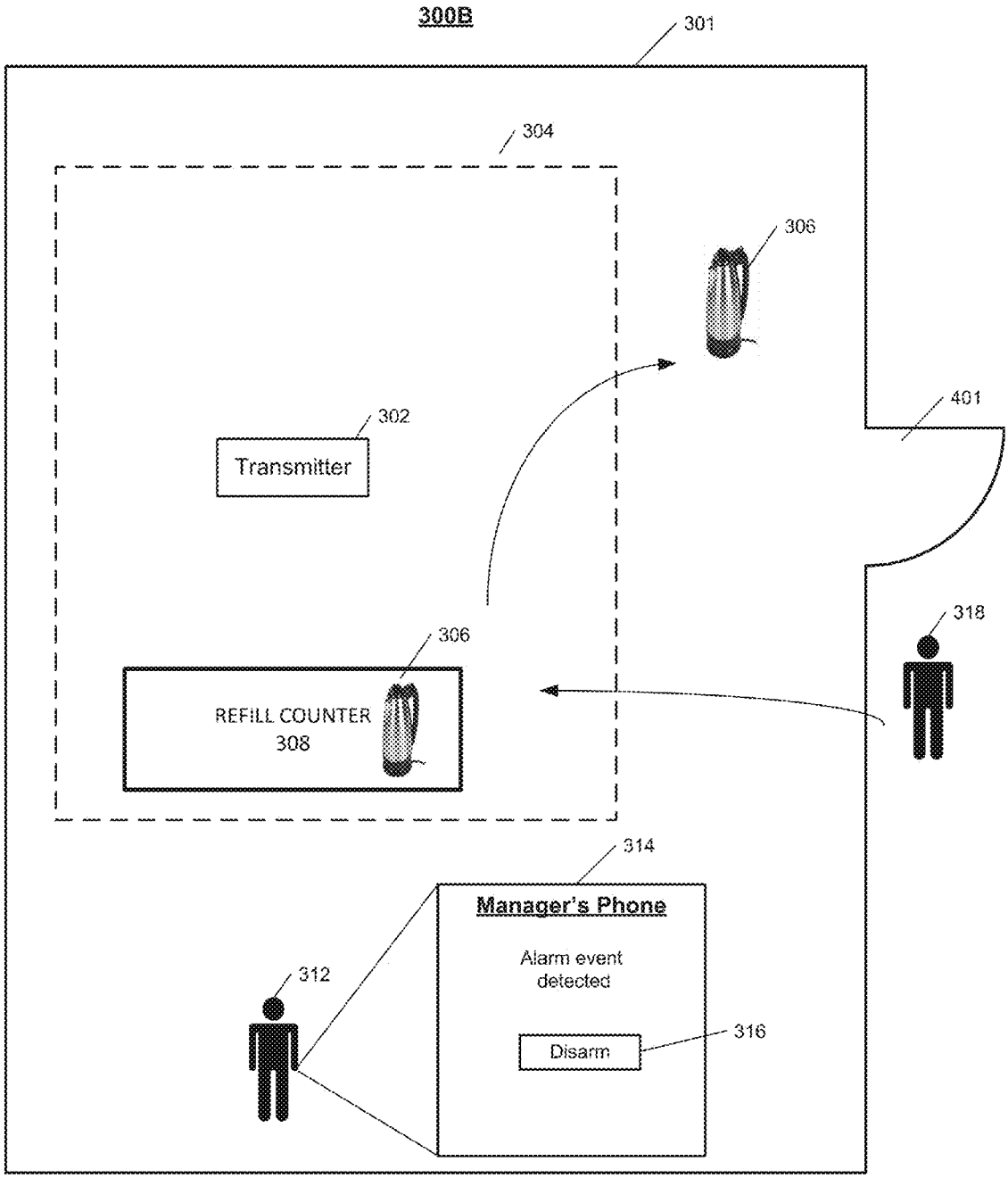
FIG. 3B illustrates an example of detecting an alarm alert.

FIG. 3B illustrates an example 300B of detecting an alarm event. In the example illustrated in FIG. 3B, a user 318 enters the monitored establishment 301, and opens a product dispenser 306 in an area of the establishment that is outside of the threshold distance 304 from the transmitter 302. The monitoring system monitors events in the monitored property based on data from one or more sensors associated with the product dispensers at the establishment. When the user 318 opens the door 401 to the establishment 301, the monitoring system may detect the opening of the door based on input from a contact sensor located at the door of the monitored property. In more detail, the monitoring system may include multiple sensors configured to act as an alarm system for the monitored establishment. The multiple sensors may include a contact sensor, a motion sensor, a glass break sensor, or any other type of sensor included in an alarm system or security system.

The user 318 moves the product dispenser 306 from the refill counter 308 and opens the dispenser. For example, a user 318 may enter a coffee shop with the intention of poisoning a creamer dispenser. The user 318 may enter the store and move the creamer dispenser to another area and attempt to open the dispenser to place a poisonous substance inside the dispenser. The control unit 114 of the monitoring system detects the product dispenser 306 has been opened based on receiving, from at least one of the condition sensors associated with the particular product dispenser, at least one sensed physical condition. For example, when opened, the temperature differential sensor associated with the particular product dispenser may sense a change in the temperature of the dispenser. The temperature differential sensor may communicate the sensed data to the control unit 114. The detected change in temperature of the particular product dispenser may indicate that the product dispenser has been opened. In some examples, the light sensor may detect a change in light intensity and communicate the change to the control unit. In some implementations, the control unit 114 may detect that the dispenser is opened based on each of the condition sensors associated with the dispenser sensing condition changes.

The control unit 114 of the monitoring system detects a location of the dispenser 306 at the time of the opening of the dispenser 306. The control unit 114 then commands the proximity sensor associated with the dispenser 306 to communicate with the transmitter 302 to detect whether the dispenser is within a threshold distance 304 from the transmitter. In some implementations, the transmitter continuously communicates with the proximity sensors associated with each of the product dispensers within an establishment. The control unit 114 determines the product dispenser 306 is not located within the threshold distance 304 from the transmitter 302 based on the sensor data from received from the proximity sensor associated with the product dispenser 306. The control unit 114 triggers an alarm event based on determining the product dispenser has been opened and is not within the threshold distance from the transmitter 302. The control unit 114 commands the monitoring server 108 to communicate the detected alarm event to the manager 312. The manager receives a notification on his phone 314 indicating that an alarm event was detected. For example, the detected alarm event may be communicated as a SMS or MMS text to the mobile device of the store manager 312. In some implementations, the notification may include details of the detected alarm event. For example, the notification may include a product dispenser number or code that identifies the dispenser that may have been compromised. In some implementations, one or more sensors associated with the product dispenser 306 may generate a visible alert.

Figure 4:
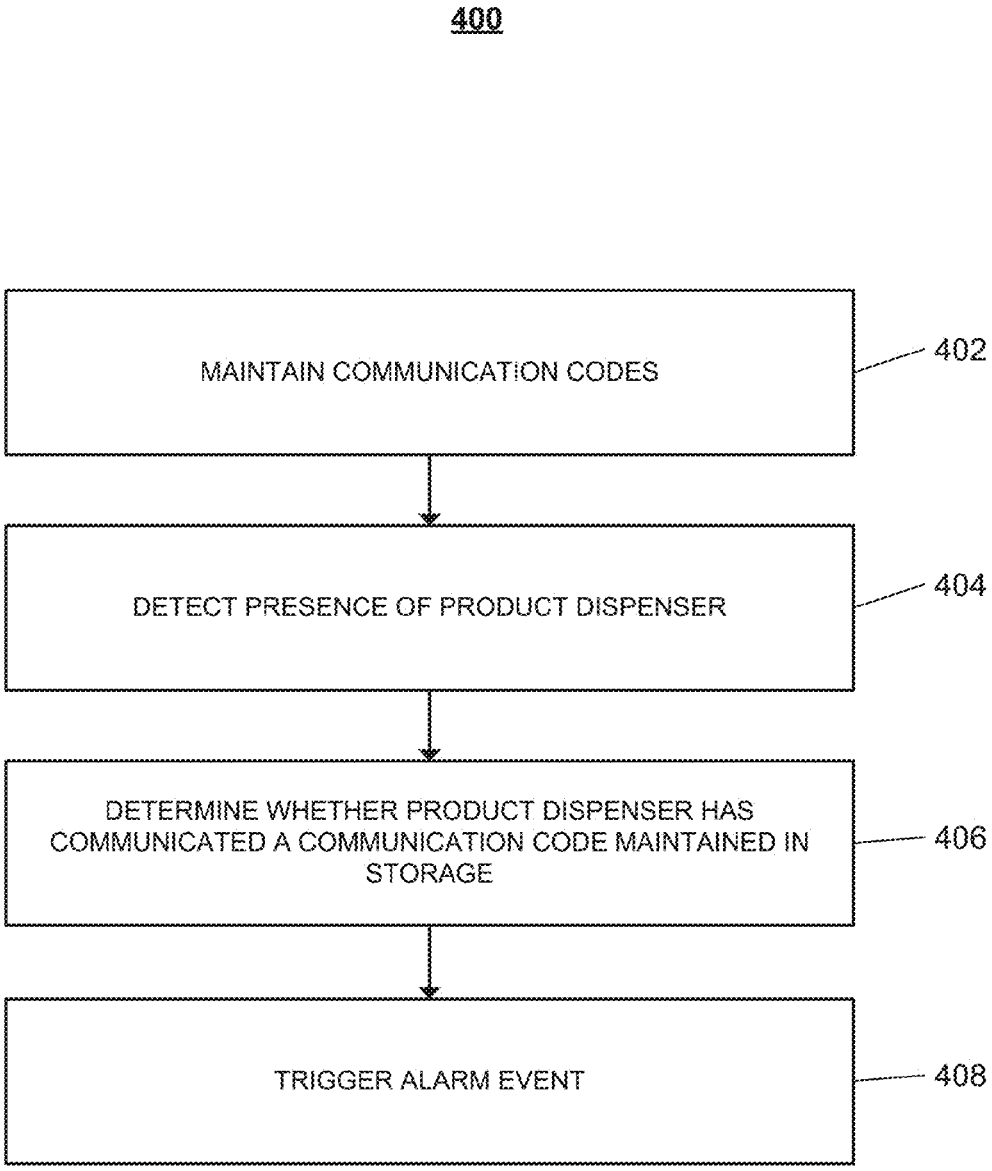
FIG. 4 illustrates an example of a process for triggering an alarm event.

FIG. 4 illustrates an example process 400 for triggering an alarm event. The process may include maintaining in electronic storage, communication codes associated with the product dispensers (402). The monitoring system may include an electronic holster for the one or more product dispensers 102, 104. The electronic holster may be a cradle that is configured to retain the one or more product dispensers. In some examples, the electronic holster may be a table top or a counter top, or any other suitable surface in an establishment. The electronic holster may be configured to synchronize with the one or more product dispensers 102, 104 during an initial set up. During the initial synchronization, the electronic holster may communicate an encrypted communication code to each of the product dispensers. The control unit 114 may store each of the communication codes that are communicated to the product dispensers. In some examples, the electronic holster may communicate the same encrypted communication code to each of the product dispensers associated with the establishment. In some implementations, the electronic holster may synchronize with the product dispensers using radio frequency identification (RFID). For example, the holster may be equipped with an RFID reader that syncs with an RFID tag on each of the one or more product dispensers.

The control unit 114 may detect the presence of a particular product dispenser at the electronic holster (404). In some implementations, the electronic holster may act as a transmitter that may communicate with the proximity sensors associated with the product dispensers to detect the location of the product. In these implementations, the electronic holster may detect when a particular product dispenser is placed into the holster. The control unit 114 may determine whether the particular product dispenser has communicated to the electronic holster a communication code maintained in electronic storage based on detecting the presence of the particular product dispenser (406). When the presence of a product dispenser is detected, the electronic holster initiates communication with the product dispenser by requesting the product dispenser to communicate a communication code to the holster. The product dispenser may communicate the code to the electronic holster, the electronic holster in turn communicates the received communication code to the control unit 114. The control unit 114 may then compare the received communication code to the list of stored communication codes. In some implementations, the product dispenser, the electronic holster, and the control unit may communicate over the network 106. In other implementations, the electronic holster and the control unit may communicate via a secured link to ensure the fast and reliable communication.

The control unit 114 may trigger an alarm event based on a determination that the particular product dispenser has failed to communicate to the electronic holster a communication code maintained in electronic storage (408). For example, a user may replace the ketchup dispenser at a fast food location with an imposter dispenser. When placed in the electronic holster, the imposter dispenser may communicate a code that does not match the stored list of communication codes and may trigger an alarm event. Alternatively, an imposter product dispenser may not communicate at all with the electronic holster and may trigger an alarm event. When the alarm event is triggered, the control unit 114 may command the monitoring server 108 to communicate the detected alarm event to the mobile device of an employee at the establishment. In some examples, the store manager may receive a notification on a mobile device that indicates an alarm event was detected. For example, the detected alarm event may be communicated as a SMS or MMS text to the store manager.

Figure 5A:
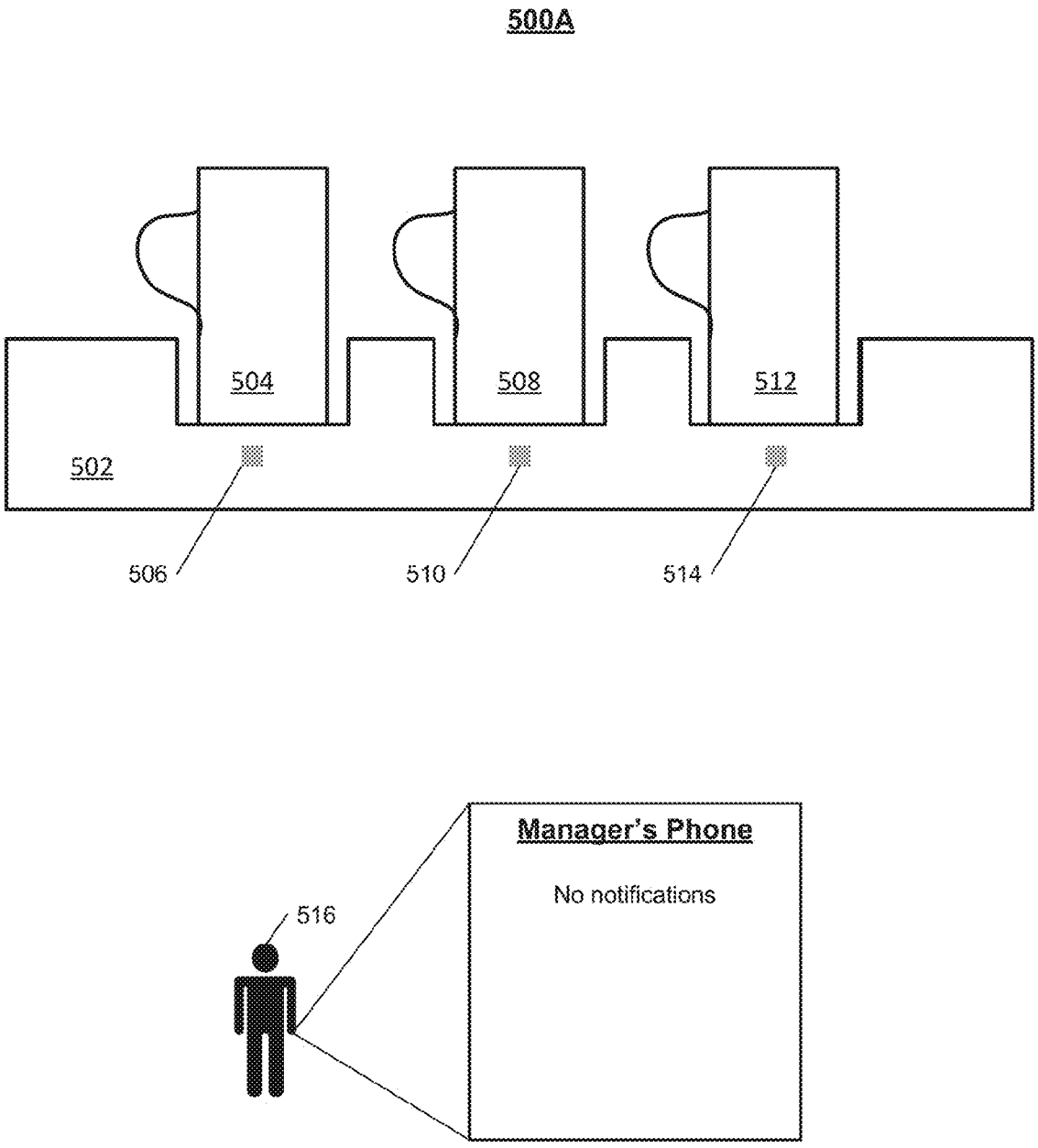
FIGS. 5A-C illustrate an example holster.
Figure 5B:
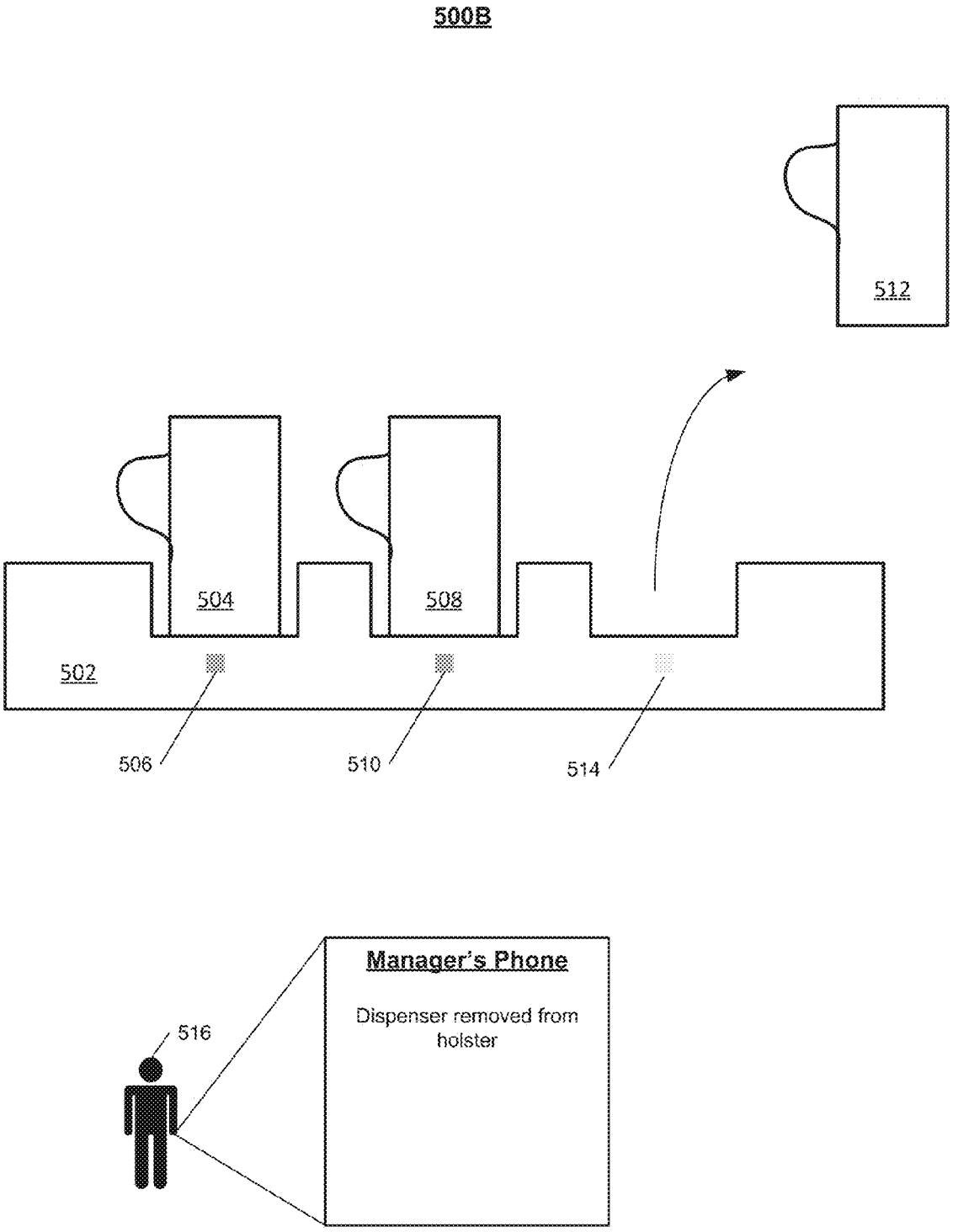
Figure 5C:
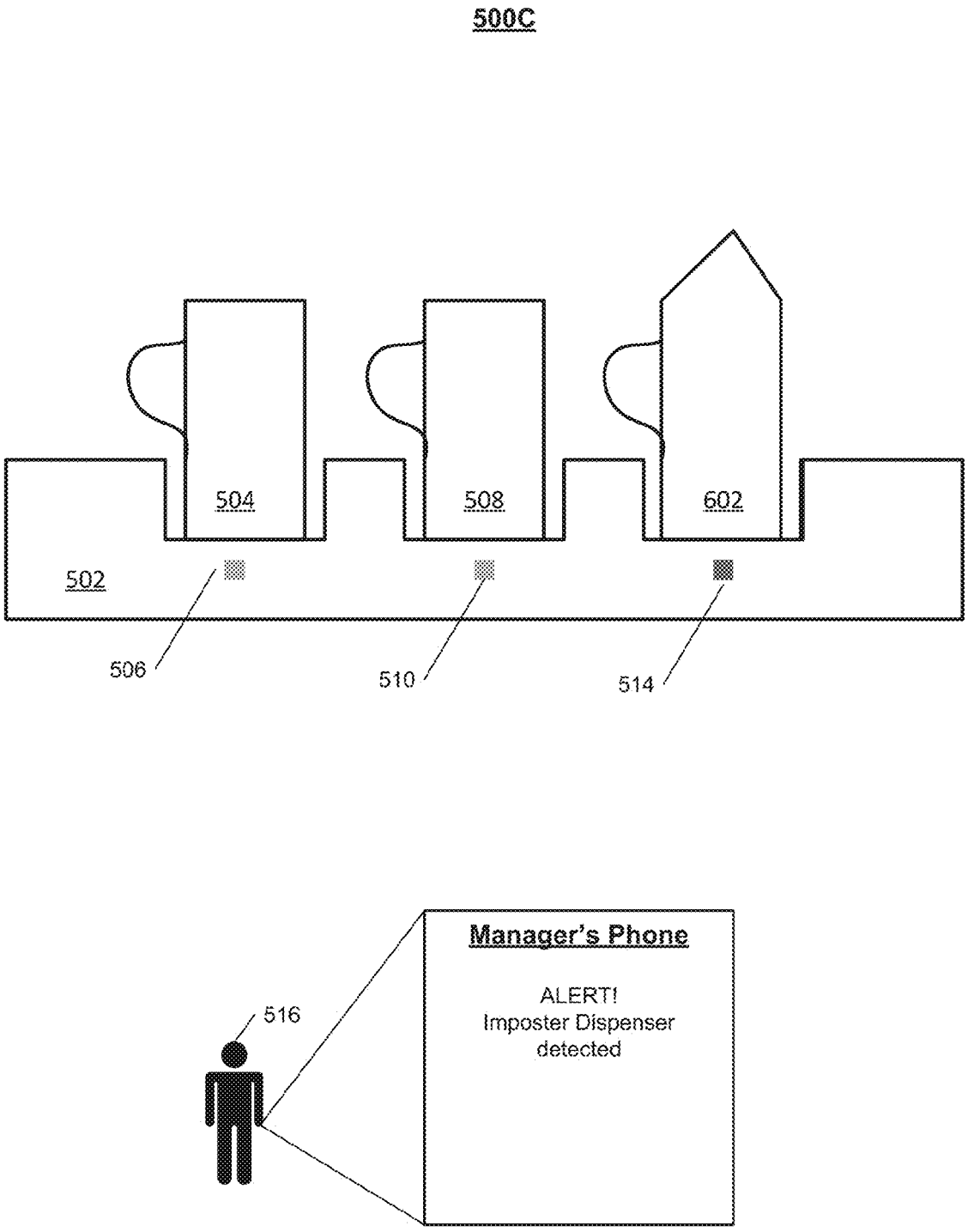

FIGS. 5A to 5C each illustrate examples of an electronic holster. As illustrated, the electronic holster 502 may be configured to hold one or more product dispensers 504, 508, and 512. In the examples illustrated, the electronic holster 502 is a cradle that is configured to retain the one or more product dispensers 504, 508, and 512. In some examples, the electronic holster may be a table top or a counter top, or any other suitable surface at an establishment. The electronic holster 502 may include one or more LEDs indicator lights 506, 510, and 514. The indicator light 506, 510, and 514 may be used as a visual status indicator of the one or more product dispensers. As illustrated, the electronic holster may include an indicator light for each product dispenser.

For the example illustrated in FIG. 5A, the indicator light 506, 510, and 514 for each of the product dispensers 504, 508, and 512 is green. The green light may indicate that each of the product dispensers have successfully synced with the electronic holster 502. In more detail, when a product dispenser is placed in the electronic holster 502, the electronic holster 502 initiates communication with the product dispenser and requests a communication code. When the electronic holster 502 receives the communication code that matches a stored communication code, the dispenser is successfully synced, and the indicator light switches on to green. The store manager 516 does not receive any notifications on his user device as illustrated, since no alarm event was detected.

As illustrated in FIG. 5B, when a product dispenser 512 is removed from the electronic holster 502, the indictor light 514 changes from green to yellow. For example, a customer at a coffee shop may remove the sugar dispenser to add sugar to their drink. The electronic holster 502 may communicate the detected removal of a product dispenser 512 from the electronic holster 502 to the control unit 114. The control unit 114 may then command the monitoring server 108 to communicate the removal of the product dispenser 512 to the mobile device of the store manager 516. The store manager 516 may receive a notification that indicates that a dispenser has been removed from the holster.

As illustrated in FIG. 5C, when an imposter product dispenser 602 is placed in the electronic holster 502, the product dispenser 602 triggers an alarm event. For example, the imposter product dispenser 602 may have failed to communicate a code to the electronic holster in response to the request from the holster to communicate a code. Alternatively, the imposter product dispenser may have communicated an invalid communication code to the holster 502. When the imposter product dispenser fails to sync with the electronic holster, the indicator light switches to red, and an alert message is communicated to the mobile device of the store manager 516. In some implementations, the electronic holster may generate an audible alert. The store manager 516 may receive a notification that indicates that an imposter dispenser has been detected.

Described systems, methods, and techniques may be implemented in digital electronic circuitry, computer hardware, firmware, software, or in combinations of these elements. Apparatus implementing these techniques may include appropriate input and output devices, a computer processor, and a computer program product tangibly embodied in a machine-readable storage device for execution by a programmable processor. A process implementing these techniques may be performed by a programmable processor executing a program of instructions to perform desired functions by operating on input data and generating appropriate output. The techniques may be implemented in one or more computer programs that are executable on a programmable system including at least one programmable processor coupled to receive data and instructions from, and to transmit data and instructions to, a data storage system, at least one input device, and at least one output device. Each computer program may be implemented in a high-level procedural or object-oriented programming language, or in assembly or machine language if desired; and in any case, the language may be a compiled or interpreted language. Suitable processors include, for example, both general and special purpose microprocessors. Generally, a processor will receive instructions and data from a read-only memory and/or a random access memory. Storage devices suitable for tangibly embodying computer program instructions and data include all forms of non-volatile memory, including by way of example semiconductor memory devices, such as Erasable Programmable Read-Only Memory (EPROM), Electrically Erasable Programmable Read-Only Memory (EEPROM), and flash memory devices; magnetic disks such as internal hard disks and removable disks; magneto-optical disks; and Compact Disc Read-Only Memory (CD-ROM). Any of the foregoing may be supplemented by, or incorporated in, specially-designed ASICs (application-specific integrated circuits).

It will be understood that various modifications may be made. For example, other useful implementations could be achieved if steps of the disclosed techniques were performed in a different order and/or if components in the disclosed systems were combined in a different manner and/or replaced or supplemented by other components. Accordingly, other implementations are within the scope of the disclosure.

What is claimed is:

1. A system for processing sensor data associated with product dispensers at an establishment, the system comprising:

proximity sensors that are configured to enable sensing of location of the product dispensers at the establishment, at least one proximity sensor being mounted to each product dispenser;

condition sensors that are configured to sense physical conditions associated with the product dispensers, at least one condition sensor being mounted to each product dispenser;

a transmitter that is configured to communicate with the proximity sensors; and a control unit that includes at least one processor, the control unit being configured to perform operations comprising:

receiving, from at least one of the condition sensors, at least one sensed physical condition associated with a particular product dispenser among the product dispensers;

determining that the particular product dispenser has been opened based on the at least one sensed physical condition associated with the particular product dispenser;

based on communication between the transmitter and at least one proximity sensor mounted to the particular product dispenser, detecting a location of the particular product dispenser at a time that the particular product dispenser has been opened;

based on the detected location of the particular product dispenser at a time that the particular product dispenser has been opened, determining whether the particular product dispenser is within a threshold distance from the transmitter at the time that the particular product dispenser has been opened; and based on a determination that the particular product dispenser is located outside the threshold distance from the transmitter at the time that the particular product dispenser has been opened, trigging an alarm event.

2. The system of claim 1, wherein the operations further comprise detecting a refill event based on a determination that the particular product dispenser is located within the threshold distance from the transmitter at the time that the particular product dispenser has been opened.

3. The system of claim 2, wherein detecting a refill event further comprises detecting a change in the physical condition associated with the particular product dispenser associated with the at least one condition sensor.

4. The system of claim 1, wherein trigging the alarm event comprises triggering an alarm event based on the transmitter failing to establish communication with the at least one proximity sensor mounted to the particular product dispenser.

5. The system of claim 1, wherein the condition sensors include a pressure differential sensor, a temperature differential sensor, and a light sensor.

6. The system of claim 1, wherein trigging the alarm event comprises generating an alarm notification and communicating the generated alarm notification to a device of a user associated with the establishment.

7. The system of claim 1, wherein trigging the alarm event comprises controlling the particular product dispenser to provide a visible alert.

8. The system of claim 1, wherein trigging the alarm event comprises controlling at least one of the particular product dispenser or the transmitter to provide an audible alert.

9. The system of claim 1, further comprising:

a monitoring application server that is configured to electronically receive, either directly or via a network communications module, data communications from the condition sensors and from at least one of the transmitter or the proximity sensors.

10. The system of claim 1 further comprising:

one or more cameras that are configured to monitor the location of the product dispensers, wherein the one or more cameras are configured to:

capture one or more images of the product dispensers at a predetermined time;

determine a count of the number of the product dispensers at the predetermined time based on the captured one or more images; and based on a determination that the count of the number of product dispensers is below an acceptable count for a threshold period of time, triggering an alarm event.

11. A system for monitoring product dispensers at an establishment, the system comprising:

an electronic holster that is configured to physically retain the product dispensers at the establishment, that is configured to detect physical presence of the product dispensers at the electronic holster, and that is configured to receive electronic information from the product dispensers based on the product dispensers being retained by the electronic holster;

communication devices that are associated with the product dispensers and that are configured to electronically communicate information from the product dispensers to the electronic holster, at least one communication device being mounted to each of the product dispensers; and a control unit that includes at least one processor, the control unit being configured to perform operations comprising:

maintaining, in electronic storage, communication codes associated with the product dispensers, each product dispenser being associated with at least one communication code;

detecting presence, at the electronic holster, of a particular product dispenser;

based on detecting presence of the particular product dispenser at the electronic holster, determining whether the particular product dispenser has communicated to the electronic holster a communication code maintained in electronic storage; and based on a determination that the particular product dispenser has failed to communicate to the electronic holster a communication code maintained in electronic storage, triggering an alarm event.

12. The system of claim 11, wherein trigging the alarm event comprises generating an alarm notification and communicating the generated alarm notification to a device of a user associated with the establishment.

13. The system of claim 11, wherein trigging the alarm event comprises controlling the particular product dispenser to provide a visible alert.

14. The system of claim 11, wherein trigging the alarm event comprises controlling at least one of the particular product dispenser or the transmitter to provide an audible alert.

15. The system of claim 11 further comprising:

proximity sensors that are configured to enable sensing of location of the product dispensers at the establishment, at least one proximity sensor being mounted to each product dispenser;

condition sensors that are configured to sense physical conditions associated with the product dispensers, at least one condition sensor being mounted to each product dispenser; and a transmitter that is configured to communicate with the proximity sensors.

16. The system of claim 15, wherein trigging the alarm event comprises triggering an alarm event based on the transmitter failing to establish communication with the at least one proximity sensor mounted to the particular product dispenser.

17. The system of claim 11, wherein the operations further comprise detecting a refill event based on a determination that the particular product dispenser is located within a threshold distance from the transmitter at the time that the particular product dispenser has been determined to be opened based on at least one sensed physical condition associated with the particular product dispenser.

18. The system of claim 17, wherein detecting a refill event further comprises detecting a change in the physical condition associated with the particular product dispenser associated with the at least one condition sensor.

19. The system of claim 11, further comprising:

a monitoring application server that is configured to electronically receive, either directly or via a network communications module, data communications from the condition sensors and from at least one of the transmitter or the proximity sensors.

20. The system of claim 10 further comprising:

one or more cameras that are configured to monitor the location of the product dispensers, wherein the one or more cameras are configured to:

capture one or more images of the product dispensers at a predetermined time;

determine a count of the number of the product dispensers at the predetermined time based on the captured one or more images; and based on a determination that the count of the number of product dispensers is below an acceptable count for a threshold period of time, triggering an alarm event.

* * * * *